United States Patent [19]

Johansson

[11] 4,112,524

[45] Sep. 12, 1978

[54] SHOWER-BATH TUB

[76] Inventor: Hans A. Johansson, Treharadsvägen 36, Eslöv, Sweden

[21] Appl. No.: 704,376

[22] Filed: Jul. 12, 1976

[51] Int. Cl.[2] ..... A47K 3/22

[52] U.S. Cl. ..... 4/148; 4/2; 4/185 S

[58] Field of Search ..... 4/148, 2, 3, 10, 173, 4/185 S, 185 R, 134, 114, 172.11, 145, 185 L

[56] References Cited

U.S. PATENT DOCUMENTS

| | | | |
|---|---|---|---|
| 1,293,829 | 2/1919 | McAuliffe | 4/185 S |
| 2,058,284 | 10/1936 | Additon | 4/173 |
| 3,419,911 | 1/1969 | Wood | 4/10 |
| 3,571,818 | 3/1971 | Jacuzzi | 4/180 |
| 3,662,409 | 5/1972 | Johansson | 4/145 |
| 3,703,733 | 11/1972 | McLoughlin | 4/185 L |
| 4,010,498 | 3/1977 | Jablonski | 4/185 R |

*Primary Examiner*—Richard E. Aegerter
*Assistant Examiner*—L. Footland
*Attorney, Agent, or Firm*—John J. Dennemeyer

[57] ABSTRACT

A shower bath tub has a bottom portion with a water outlet, and an upright portion on this bottom portion provided with a top which has a funnel shaped collecting bowl extending down into a space where it is connected to a discharge conduit. A toilet seat is disposed above the collecting bowl and the shower water flushes any feces from the toilet seat and the collecting bowl into the discharge conduit.

7 Claims, 3 Drawing Figures

SHOWER-BATH TUB

The present invention relates to an improved shower-bath tub having at least one shower water emitting device for washing a person sitting on a seat disposed within the tub, the shower-bath tub comprising a bottom portion provided with a shower water discharge and an upright portion, the improvement according to the invention residing in that a holed part of the upright portion forms the bottom of a space within the tub adapted to have the seat disposed therein during washing, in that this holed part is spaced substantially beneath the seat when disposed in this space and with its hole aligned beneath a hole made in the seat, and in that a space beneath the upright portion is provided with a discharge device for collecting and flushing away faces passing down through the holes in the seat and in the holed part.

Shower-bath tubs of the kind mentioned above usually enable a satisfactory washing effect, but they are unsuited for use at the same time as water closets. If a person should evacuate his bowels while washing in a tub of the conventional kind—which often occurs at hospitals and special nursing homes substantial problems may arise in connection with a satisfactory cleaning of the tub.

It is an object of the present invention to provide a shower-bath tub in which a WC function is provided without increasing the space requirement relative to conventional shower-bath tubs, in which furthermore the shower water is discharged at a different point than feces, so that feces cannot block the shower water discharge, and in which a person may also be washed and dried from beneath without the necessity of lifting the person from the position in which the washing operation takes place.

The invention will be disclosed in greater detail with reference to the accompanying drawings, in which.

Figure 1:
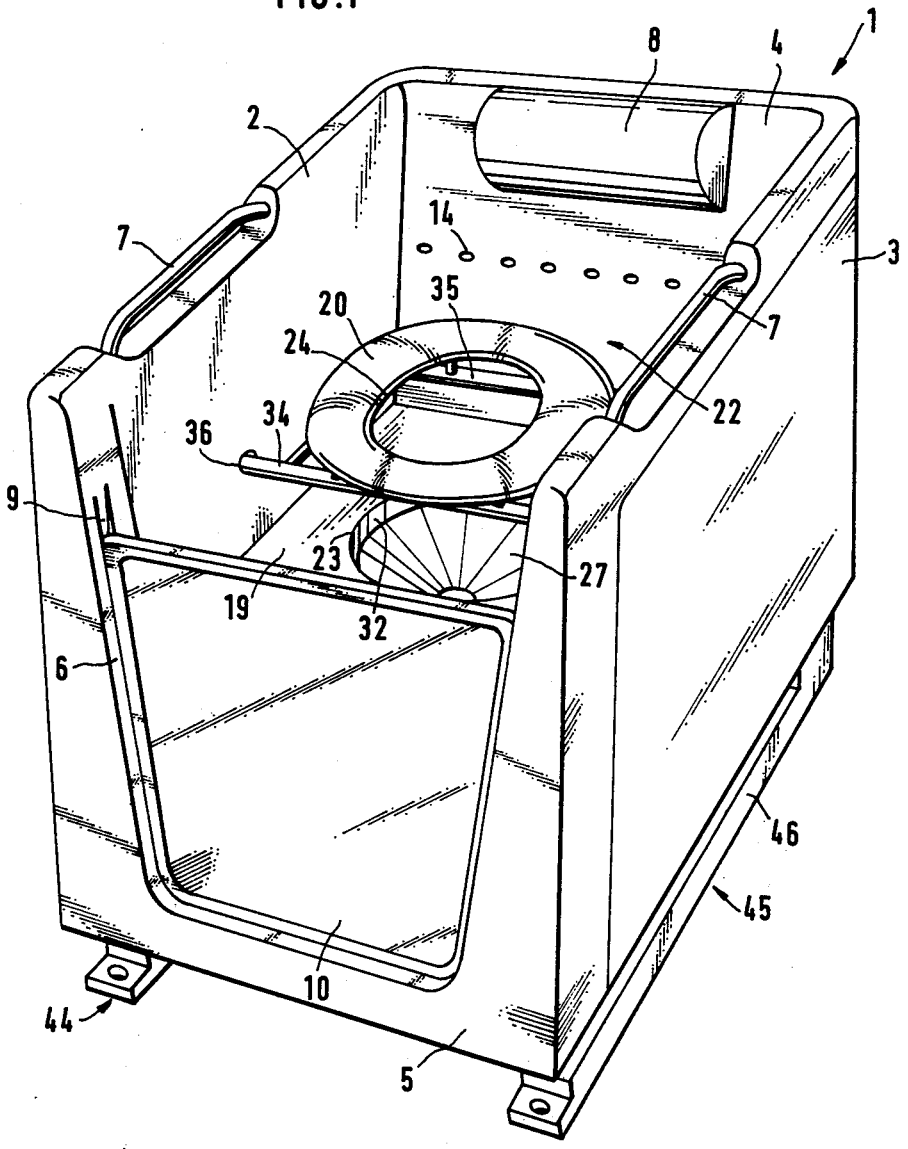
FIG. 1 is a perspective view illustrating a shower-bath tub according to the invention and having a seat disposed therein.

The shower-bath tub 1 illustrated by way of example has two side walls 2 and 3, a rear wall 4 and a front wall 5, the latter being provided with a door opening 5. The side walls 2, 3 are provided with supporting handles 7 to be held onto by the person while being washed; the rear wall 4 is provided with a cushion 8 against which the person may lean, and the front wall 6 has guideways 9 enabling a door 10 to be withdrawn and removed.

The shower-bath tub 1 has a shower water emitting device comprising at least one supply conduit 11 which is connected to the domestic water supply net (not shown) and is provided with a shut-off and/or control valve 12 which opens into at least one inlet manifold 13 having distributing orifices or nozzles 14 and which projects shower sprays against the occupant of the tub 1. The distribution orifices or nozzles 14 may be disposed in a row in the rear wall 4, but may also be arranged otherwise, such as, for example, in several rows and/or in more than one wall. The temperature of the shower water may be controlled by means of a conventional hot-cold-water mixing faucet (not shown).

The shower-tub 1 comprises a bottom portion 16 provided with a shower water discharge 15, and adjucent thereto an upright portion 17, the shower water collecting in the bottom portion 16 being conducted so as to flow down into a conventional gully 17A disposed therebelow for further discharge into a sewage disposal system 18.

In order to enable a WC function without the necessity of increasing the dimensions of the tub, without any risk of blocking gullies serving solely for waste water, and without creating any difficulties for the subsequent cleaning process, and, on the other hand, to enable the occupant of the tub to be cleaned and/or dried from beneath, the shower-bath tub or equipment 1 according to the invention is mainly characterized in that a holed part 19 of the upright portion 17 forms the bottom of a space 22 adapted to have a seat 20 (FIGS. 1 and 2) or 21 (FIG. 3) disposed therein during washing. This holed part 19 is spaced substantially beneath the seat 20 or 21 disposed within the space 22 and with its hole 23 beneath a hole 24 provided in the seat 20 or 21. Furthermore, within a space 25 beneath the upright portion 17 a discharge 26 is disposed for collecting and flushing away feces passing downward through the holes 24 and 23 in the seat 20 or 21 and the holed part 19.

In order to accomplish appropriate collecting and effective removal of feces by simple expedients which can be accommodated in the existing space, the discharge 26 comprises a bowl 27 for collecting feces. Connected to the bowl 27 is at least one flush-water pipe 28 being suitably connected to the domestic water supply (not shown), and the water flushing operation is controlled by a diagrammatically indicated valve 29. The bowl 27 is connected at its bottom to a discharge conduit 30 having a drain trap portion 31 and serving for discharging waste products into the sewage disposal system 18.

In order to obtain maximum flushing effect with simple expedients, the holed part 19 has a depending flange 32 extending about the periphery of its hole 23 and projecting down into the upper portion of the bowl 27 so as to form therein an inner wall of a flushing channel 33 which opens downwardly and into which the flush-water pipe 28 opens.

Figure 2:
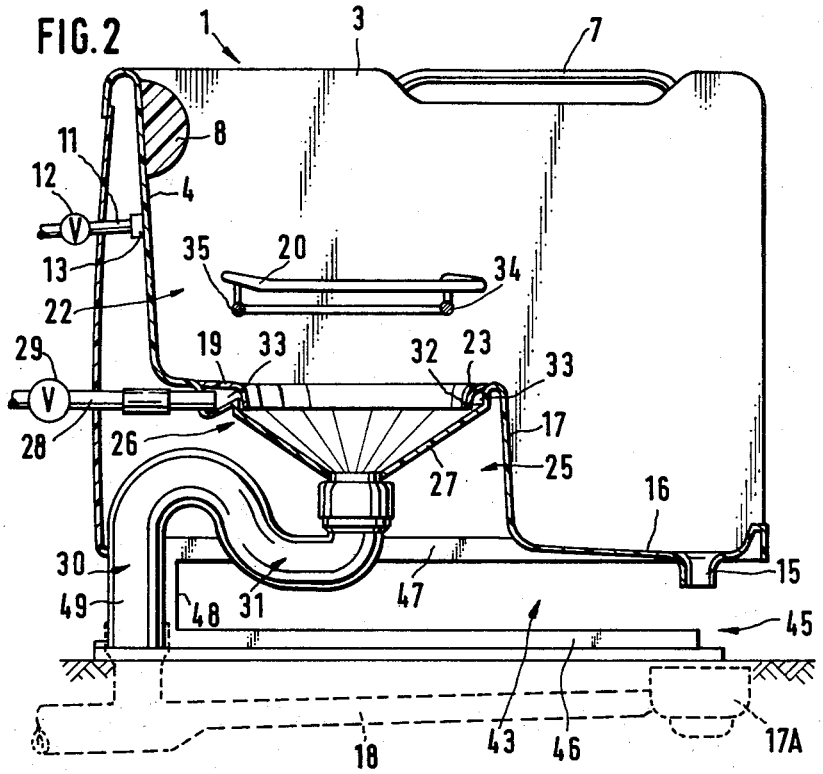
FIG. 2 illustrates the shower-bath tub in side elevation and partly in section.

In the embodiment illustrated in FIGS. 1 and 2, a seat 20 is carried in the space 22 by carrier members 34, 35 for the seat mounted in brackets 36 attached to the side walls 2 and 3.

Figure 3:
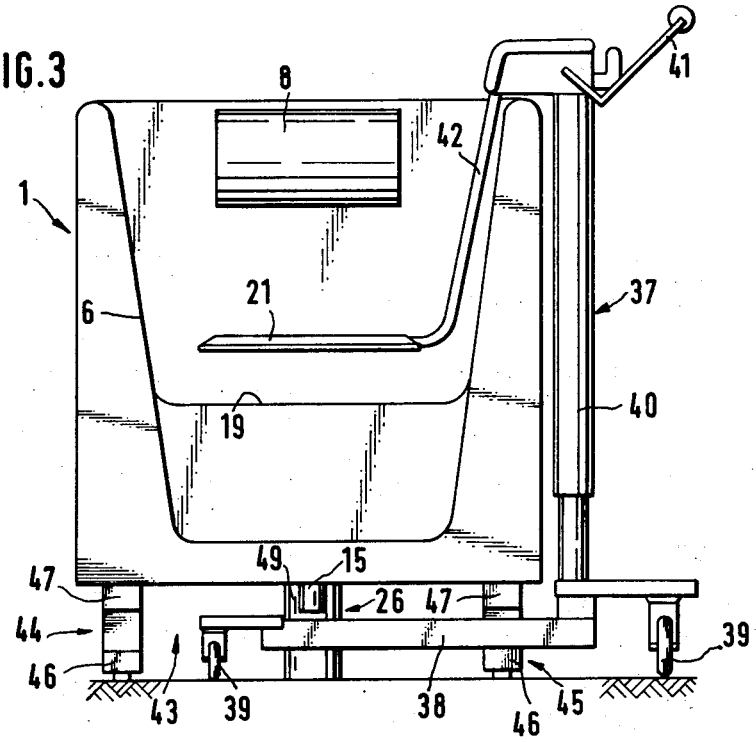
FIG. 3 is a front elevational view of a shower-bath tub according to the invention, the door being open and the seat of the tub as shown in FIGS. 1 and 2 being replaced by a seat carried by a wheelchair.

The shower-bath tub or equipment 1 according to the invention could, optionally, be used for washing a person sitting on the seat of a wheel-chair 37, as shown in FIG. 3. For such usage, the seat arrangement 20 within the tub 1 is omitted or removed, the door 10 is removed, and the wheel-chair 37 is advanced into the tub 1 until its seat 21 occupies its intended position in the space 22, in which position a hole (not shown) in this seat 21 is vertically aligned or substantially aligned above the hole 23 in the upright portion 17. Other than for the elimination of the seat 20 therefrom and the substitution of the seat 21 and its supporting wheel-chair 37, the shower-bath tub or equipment of FIGS. 1 and 2 is identical to the shower-bath tub or equipment 1 of FIG. 3.

The wheel-chair 37 may comprise a low undercarriage 38 having three or four wheels 39 and a telescoping elevating column 40 having a built-in lifting gear (not shown) which is operable by a handle or lever 41.

At the top of the vertically movable part of the elevating column 40 at least one carrier arm 42 is attached which extends downward and carries the seat 21.

To enable the seat 21 to be disposed in its intended position within the tub 1 by means of a simple wheel chair 37 of the above-described kind, the discharge arrangement 26 may be disposed within the space 25 in the tub 1 which is defined by the upright portion 17, in which case the drain trap portion 31 projects at least in part into said space 25 and extends above the basement surface for the tub 1 so as to form beneath the tub 1 a space or compartment 43 which is open toward three sides of the tub 1, whereby the undercarriage of the wheel-chair 37 can be moved in beneath the tub 1.

The space 43 may be created by the use of one or more U-shaped frame members 44, 45 disposed with their legs 46, 47 lying horizontally and with their web portion 48 forming a substantially vertically extending carrying frame portion. The drain trap portion is connected to the sewage system 19 through a conduit portion 49 which extends downward along the web portion 48, thereby blocking one side only of the space 43, whereas the remaining sides thereof are left open.

The arrangement described herein by way of example is intended to elucidate the present invention without restricting it to the embodiment disclosed. The design and disposition of details forming part of the exemplified arrangement may be varied without departing from the inventive concept.

What is claimed is:

1. A shower-bath tub adapted to rest on a supporting surface, and having at least one shower water emitting device for washing a person sitting on a seat disposed within the tub, the shower-bath tub comprising a bottom portion provided with a shower-water discharge and an upright portion disposed adjacent said bottom portion, the improvement consisting in that: a holed part of said upright portion forms the bottom of an area within the tub adapted to have said seat disposed therein during washing, said holed part being spaced substantially beneath said seat when said seat is disposed in said area with the hole in said holed part aligned beneath a hole provided in said seat, and in that a space is provided beneath said upright portion and has a discharge device housed therein for collecting and flushing away feces passing down through said aligned holes in said seat and in said holed part, said discharged device comprising a bowl disposed beneath said holed part for collecting feces, at least one flushing water conduit connected to said bowl for flushing away feces, and a discharge conduit connected to the bottom of said bowl for conveying feces into a sewage disposal system, said discharge conduit including a drain-trap portion, and said holed part including a rim depending from the periphery of the hole therein so as to project downwardly into the upper portion of said bowl and to form within the latter an inner wall of an annular downwardly opening flushing channel into which said flushing water conduit opens, said discharge device being disposed so that the drain-trap portion of said discharge conduit is spaced above said supporting surface, and there being a compartment formed between the bottom of said shower-bath tub and said supporting surface, said compartment being open toward three sides of the tub, and said tub further including: a wheel-chair having a low undercarriage receivable with said compartment beneath the tub, said undercarriage carrying column means being arranged to extend vertically of said tub; carrier arm means on the upper end of said column means; and a seat carried by said carrier arm means, and positionable within said tub.

2. A shower-bath tub according to claim 1, wherein the drain-trap portion of the discharge conduit is connected to a sewage disposal system through a conduit portion which extends downwardly from the space defined by said upright portion at the fourth side of the shower-bath tub, removed from the three open sides of said compartment beneath said tub, said conduit portion being separated from said compartment by a frame member.

3. A shower-bath tub adapted to rest on a supporting surface, including:

a tub having side walls, a front wall, a rear wall, and a bottom wall;

water closet means disposed within said tub near said rear wall thereof, said water closet means including a generally horizontal wall portion provided with an opening, and a discharge device located below said opening for collecting and flushing away feces, said discharge device including a conduit portion extending downwardly from the rear end of said tub and connectable with a sewage disposal system;

shower water emitting means arranged within said tub and spaced above said water closet means;

bracket means secured to the underside of said bottom wall and adapted to support said tub in a position with said bottom wall spaced above said supporting surface, whereby to form a compartment beneath said tub that is open on three sides; and a wheelchair having a low profile undercarriage that is receivable within said compartment, said wheelchair including a patient seat having an opening therein and which is supported at a level spaced along said generally horizontal wall portion of said water closet means, said wheelchair undercarriage being maneuverable within said compartment to locate said seat above said opening of said water closet means.

4. A shower-bath tub according to claim 1, wherein said column means is telescopically arranged, and further including gear means for adjusting the height of said column means.

5. A shower-bath tub according to claim 3, wherein said bracket means comprises:

a pair of elongated, parallel U-shaped frames arranged to extend parallel to the side walls of said tub, and secured to said bottom wall thereof, the closed ends of said frames being disposed adjacent said rear end of said tub.

6. A shower-bath tub according to claim 5, wherein said conduit portion at said rear end of said tub is separated from said compartment by a frame element, whereby it is protected from being damaged by said undercarriage of said wheelchair.

7. A shower-bath tub adapted to rest on a supporting surface, including:

a tub having side walls, a front wall, a rear wall, and a bottom wall, at least a portion of said front wall being removable to provide access to the interior of said tub;

water closet means disposed within said tub near said rear wall thereof, said water closet means including a generally horizontal wall portion provided with an opening, and a discharge device located below said opening for collecting and flushing away feces, said horizontal wall portion being positioned at a height not greater than about midway the height of said side walls, and being connected with said side walls and said rear wall;

a seat having an opening therein;

means for supporting said seat within said tub, in a position spaced above said horizontal wall portion and with the opening of said seat aligned vertically with said opening in said horizontal wall portion;

said means for supporting said seat comprising a wheelchair having a low profile undercarriage, and wherein bracket means are provided to support said tub in an elevated position above said supporting surface whereby to form a compartment beneath said tub that is open on three sides, and which is adaptable to receive said low profile undercarriage of said wheelchair; and shower water emitting means arranged within said tub and spaced above said water closet means, effective to thoroughly cleanse a patient carried on said seat, the vertical spacing between said seat and said horizontal wall portion being sufficient to allow shower water to play on and completely wash the patient with spent shower water flowing over and cleansing said horizontal wall portion.

* * * * *